US009157609B2

(12) United States Patent
Littman Gatof et al.

(10) Patent No.: US 9,157,609 B2
(45) Date of Patent: Oct. 13, 2015

(54) LIGHT FIXTURE WITH TILTING LIGHT AND FIXED HEAT SINK

(71) Applicants: Bonnie A. Littman Gatof, Scarsdale, NY (US); Jonathan I. Jones, Highland, NY (US); Oriana J. Starr, New Paltz, NY (US)

(72) Inventors: Bonnie A. Littman Gatof, Scarsdale, NY (US); Jonathan I. Jones, Highland, NY (US); Oriana J. Starr, New Paltz, NY (US)

(73) Assignee: USAI, LLC, New Windsor, NY (US)

( * ) Notice: Subject to any disclaimer, the term of this patent is extended or adjusted under 35 U.S.C. 154(b) by 0 days.

(21) Appl. No.: 14/612,680

(22) Filed: Feb. 3, 2015

(65) Prior Publication Data

US 2015/0219317 A1 Aug. 6, 2015

Related U.S. Application Data

(60) Provisional application No. 61/935,164, filed on Feb. 3, 2014.

(51) Int. Cl.

| | |
|---|---|
| ***F21V 31/00*** | (2006.01) |
| ***F21V 21/30*** | (2006.01) |
| ***F21V 17/02*** | (2006.01) |
| ***F21V 29/70*** | (2015.01) |
| ***F21V 19/02*** | (2006.01) |
| *F21Y 101/02* | (2006.01) |

(52) U.S. Cl.
CPC ..... *F21V 17/02* (2013.01); *F21V 19/02* (2013.01); *F21V 29/70* (2015.01); *F21Y 2101/02* (2013.01)

(58) Field of Classification Search
CPC ..... F21V 31/00; F21V 15/01; F21V 21/30
USPC ..... 362/271, 249.02, 235, 231
See application file for complete search history.

(56) References Cited

U.S. PATENT DOCUMENTS

| | | | | |
|---|---|---|---|---|
| 6,779,908 | B1 * | 8/2004 | Ng | 362/147 |
| 7,559,677 | B1 * | 7/2009 | Dupre | 362/287 |
| 8,029,173 | B2 * | 10/2011 | Ko | 362/427 |

* cited by examiner

*Primary Examiner* — Tracie Y Green
(74) *Attorney, Agent, or Firm* — St. Onge Steward Johnston & Reens LLC

(57) ABSTRACT

A light fixture having a light source, first and second heat sinks with corresponding first and second thermal interfaces having complementary curved surfaces, and a linkage having cams, and springs to create contact pressure between the thermal interfaces when the light fixture is in an operation mode and to permit movement between the thermal interfaces when the light fixture is in an adjustment mode. When the light fixture is in operation mode, the first and second heat sinks work in combination to provide a highly effective heat dissipation system. When the light fixture is in adjustment mode, the separation created permits the light source to move along an adjustment path to change the angular direction of the light emitted and to rotate about a rotational axis, providing a full range of directional lighting orientations.

20 Claims, 9 Drawing Sheets

LIGHT FIXTURE WITH TILTING LIGHT AND FIXED HEAT SINK

FIELD OF THE INVENTION

The invention pertains to the field of light fixtures, and, in particular to adjustable light fixtures.

BACKGROUND OF THE INVENTION

Recessed lighting is very popular in residential and commercial buildings given its unobtrusive and aesthetically pleasing appearance. Recessed lighting removes from view all electric hardware and wiring, placing everything behind a wall or ceiling. However, recessed light fixtures, specifically those with an LED light source, generate heat when the light source is illuminated. This heat can become substantial and can cause certain components of the light fixture to fail or can cause even more significant emergencies, such as fires.

As such, there is a need in the art for effective heat dissipation systems for light fixtures employing LED light sources. It is further desirable for the light fixture to provide adjustable orientations of the light source to direct the light emanating from the light fixture. Optimally, this can be accomplished by providing angular adjustment in combination with rotation about an axis, permitting a full range of angled directional lighting about a rotational axis.

It is therefore desired to provide a light fixture that combines a heat dissipation system with a full range of angular and rotational orientation options for the light emission direction, especially for a recessed light fixture employing one or more LEDs as a light source. Because heat dissipation systems can be large and somewhat unwieldy, there is a need in the art for an effective system that can be used in a recessed light fixture while retaining the desired flexibility of light emission orientations.

SUMMARY OF THE INVENTION

Accordingly, it is an object of the present invention to provide a highly effective heat dissipation system in combination with the art's need for re-orientation of the light source to allow directional lighting. It is a further object of the present invention to provide a manner of locking the light fixture's heat dissipation system while in an operation mode to optimize the system's effectiveness.

These and other objectives are achieved by providing a light fixture having a light source, first and second heat sinks with corresponding first and second thermal interfaces having complementary surfaces, and means to create contact pressure between the thermal interfaces when the light fixture is in an operation mode and to permit movement between the thermal interfaces when the light fixture is in an adjustment mode. When the light fixture is in operation mode, the first and second heat sinks work in combination to provide a highly effective heat dissipation system. When the light fixture is in adjustment mode, the separation created permits the light source to move along an adjustment path to change the angular direction of the light emitted and to rotate about a rotational axis, providing a full range of directional lighting orientations.

The present invention accomplishes its objectives by providing a light fixture comprising a light source, first and second heat sinks, the light source being mounted to the first heat sink and the first heat sink being operable to conduct heat generated by the light source during operation. The light fixture has both an operation mode and an adjustment mode, In the operation mode, the first heat sink is fixed relative to the second heat sink and a first thermal interface of the first heat sink is pressed into contact with a second thermal interface of the second heat sink in a contact area such that the second heat sink operates to conduct heat from the first heat sink through the contact area and dissipate the heat into an ambient environment. In the adjustable mode, the first heat sink is movable relative to the second heat sink to a plurality of operation positions to allow adjustment of the light source's position relative to the second heat sink. The light fixture is operational in either the operation mode or the adjustment mode and in any of the plurality of operation positions.

In some embodiments, the light fixture also comprises a means to generate contact pressure between the first and second thermal interfaces while the light fixture is in operation mode.

In certain embodiments, the first thermal interface is displaced from the second thermal interface while the light fixture is in adjustment mode.

In some embodiments, the contact area of the first and second thermal interfaces of the first and second heat sinks is at least about 100 $cm^2$.

In certain embodiments, the first heat sink is continuously movable relative to the second heat sink along an adjustment path when the light fixture is in adjustment mode, and the light fixture is operable to be in either the operation mode or the adjustment mode at any position along the path.

In some embodiments, the adjustment path is curved, and the first and second thermal interfaces have complementary curved surfaces. In certain embodiments, the first thermal interface has a convex curved surface and the second thermal interface has a concave curved surface, or vice versa.

In some embodiments, the first thermal interface is in the form of a partially cylindrical convex surface, the second thermal interface is in the form of a partially cylindrical concave surface complementary to the first thermal interface, and the arc length of the second thermal interface is substantially greater than the arc length of the first thermal interface.

In certain embodiments, the light fixture also comprises a means for changing the mode of the light fixture between operation and adjustment modes. The mode changing means may also be operable to maintain the light fixture in operation mode.

In some embodiments, the mode changing means can comprise a first guide fixed relative to the second heat sink and a first cam connected to the first heat sink. While in operation mode, the first cam bears on the first guide, thereby pressing the first thermal interface against the second thermal interface. While in adjustment mode, the first cam releases the first thermal interface from the second thermal interface.

In certain embodiments, the first cam of the mode changing means is connected to the first heat sink through an elastic means. When in operation mode, the elastic means would be deformed; when in adjustment mode, the elastic means would be at rest.

In some embodiments, the first cam of the mode changing means has a flat surface that, when the light fixture is in operation mode, bears on the guide to maintain the light fixture in operation mode.

In certain embodiments, the mode changing means also comprises a second guide fixed relative to the second heat sink and first and second pairs of cams connected to the first heat sink through the elastic means, with the first and second pairs of cams deposed on opposed sides of the first thermal interface. When in operation mode, the first and second pairs of cams bear on the first and second guides, respectively, and press the first thermal interface against the second thermal interface. When in adjustment mode, the first and second pairs of cams release the first thermal interface from the second thermal interface.

In some embodiments, the mode changing means also comprises a linkage connected to the first and second pairs of cams. In certain embodiments, the linkage comprises a handle adapted to articulate the linkage to change the light fixture between operation and adjustment modes, with the handle accessible by the user through an aperture of the light fixture.

In some embodiments, the light fixture also comprises an illumination aperture that permits light emanating from the light source to pass through. The illumination aperture has an aperture plane, and as the light fixture slides along the adjustment path, the optical axis of the light source will pass through the aperture plane at different angles.

In certain embodiments, the light fixture further comprises a support, and the second heat sink can rotate relative to the support and the first heat sink is supported by the second heat sink.

Other objects of the invention and its particular features and advantages will become more apparent from consideration of the following drawings and accompanying detailed description.

DETAILED DESCRIPTION OF THE INVENTION

Figure 1:
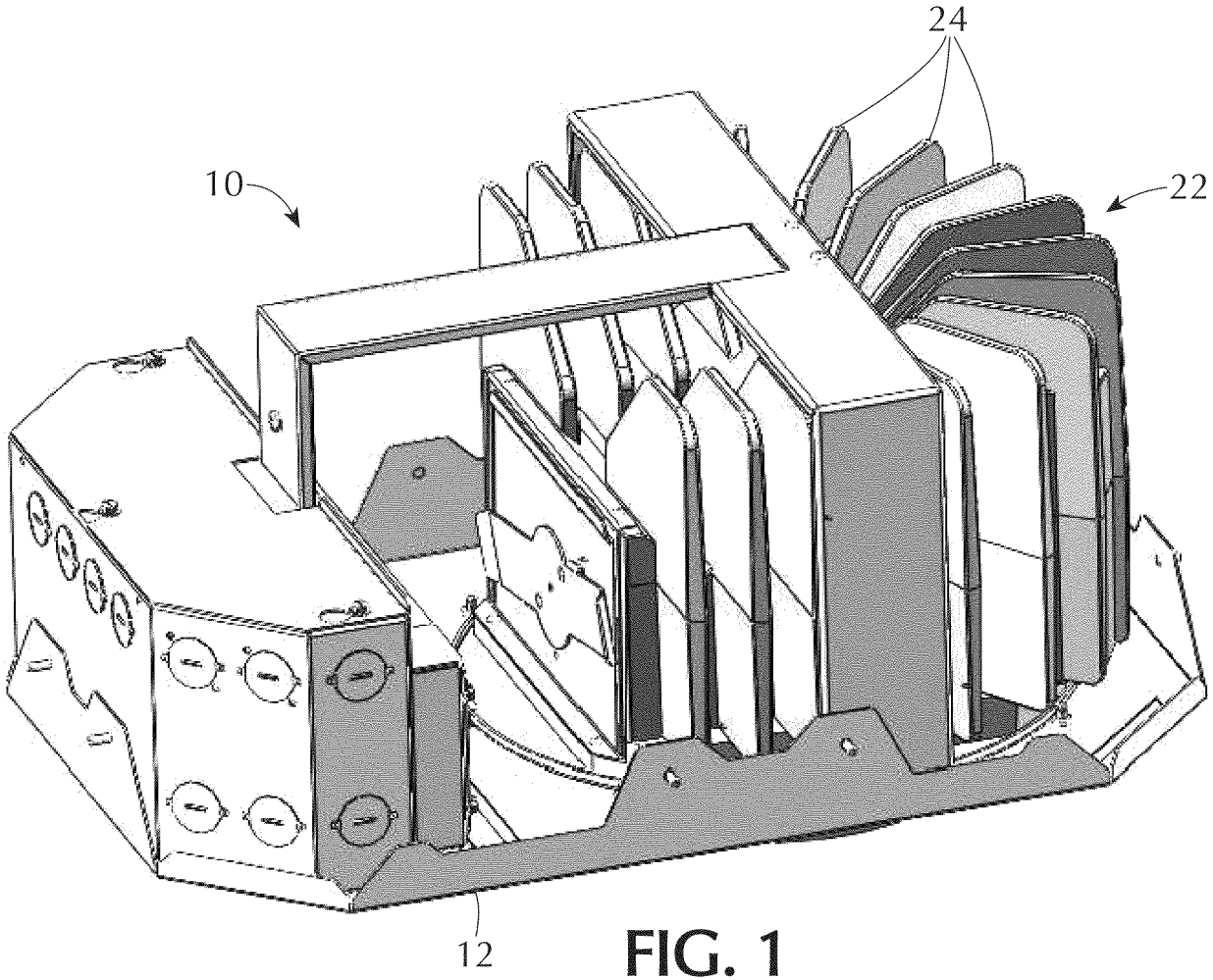
FIG. 1 is a perspective view of one embodiment of an adjustable light fixture constructed in accordance with the invention, showing the light source in a first rotational orientation.
Figure 2:
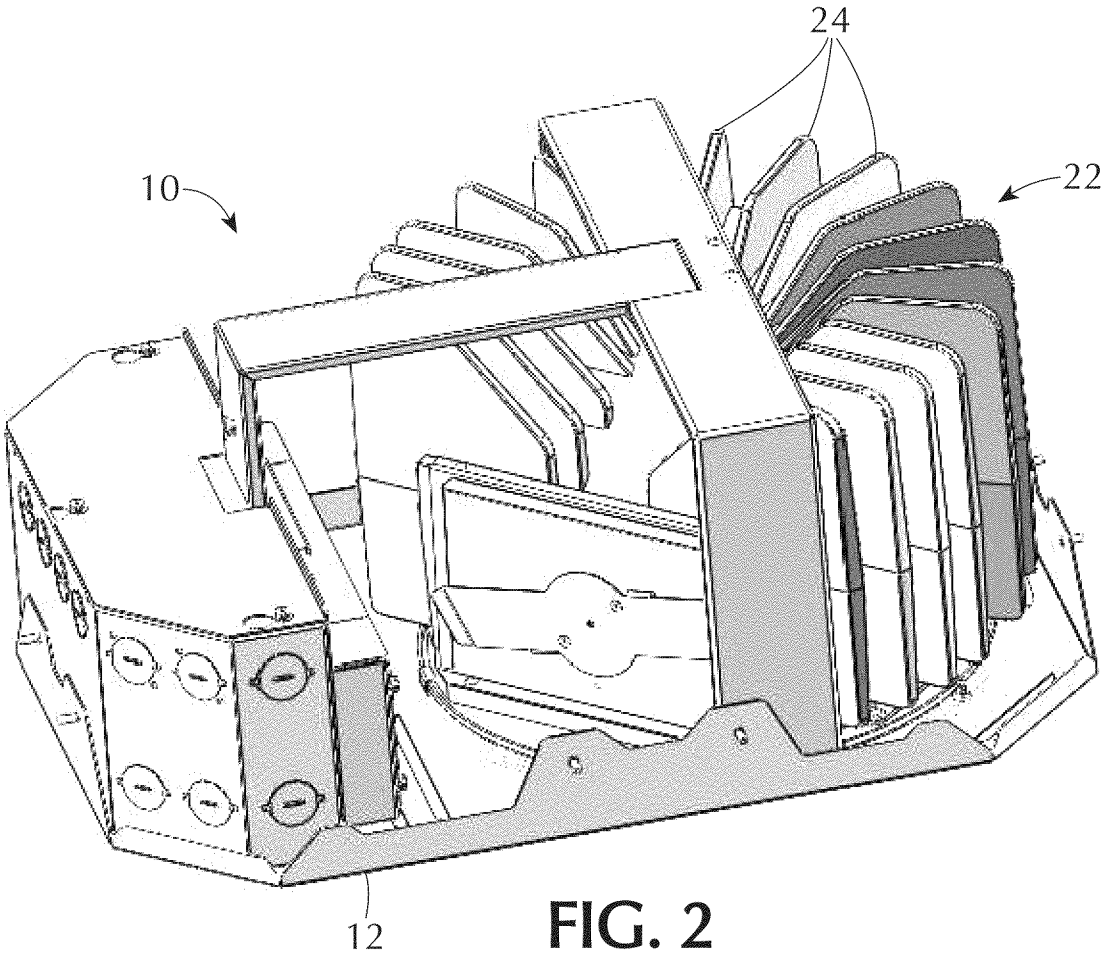
FIG. 2 is a perspective view of the light fixture of FIG. 1, showing the light source in a second rotational orientation.

Referring to FIGS. 1-9, an embodiment of a light fixture 10 constructed in accordance with the invention preferably has a support frame 12 providing a support for affixing the light fixture to an external support structure, such as a ceiling or wall structure (not shown). The light fixture 10 also has a light source 14, such as a Light-Emitting Diode (LED), or another suitable light source, for emitting light through an aperture 30 of the light fixture 10. The light fixture 10 is adapted to permit tilting and rotation of the light source 14 relative to the support 12 to allow aiming of the light beam emitted from the light fixture.

The light fixture 10 has a heat dissipation system comprising several heat sinks, preferably comprised of thermally conductive material such as aluminum (or another suitable material), which cooperate to dissipate heat generated by the light source, while allowing for adjustment of tilt and rotation positions of the light source. The heat dissipation system includes a first heat sink 16 fixedly connected to the light source 14, which is operable to conduct heat away from the light source 14 during operation of the light fixture 10. The first heat sink 16 has a base 18 which is thermally coupled to the light source 14 (and/or a mount for the light source), and has a thermal interface 20, which is opposite the base 18. For example, in the case of a Light-Emitting Diode (LED) light source, where one or a plurality of LEDs are mounted to a substrate such as a printed circuit board (PCB) or the like, the base 18 of the first heat sink 16 can be connected to a side of the substrate opposite the LEDs and the thermal interface is disposed on a side of the first heat sink 16 opposite the base 18 such that the first heat sink is operable to conduct heat from the light source 14 to the thermal interface 20 through a body of the heat sink.

The light fixture 10 includes a second heat sink 22 preferably having heat dissipating fins 24 disposed on an exterior surface thereof and having a thermal interface 26 on an interior thereof adapted to engage and thermally couple with the thermal interface 20 of the first heat sink 16.

The second heat sink 22 is preferably rotatably mounted to the support 12, for rotation about a rotation axis which is preferably aligned (co-linear) with a center axis 28 of the light fixture passing through a center 31 of the aperture 30 of the light fixture 10 perpendicular to a plane of the aperture. Preferably, the second heat sink 22 is operable to rotate more than 360 degrees about the rotation axis, but the light fixture 10 includes an over-rotation stop to prevent rotation greater than a predetermined amount, for example more than 365 degrees. Further, the light fixture 10 preferably includes a rotation lock to selectively permit and prevent rotation of the second heat sink, which lock is accessible through the aperture.

The first heat sink 16 and light source 14 are preferably mounted to and supported by the second heat sink 22 such that rotation of the second heat sink 22 about the rotation axis results in rotation of the first heat sink 16 and light source 14. This rotation allows for rotational aiming of the optical axis of the light source about the rotation axis.

The light fixture 10 has an operation mode wherein the tilt position of the light source 14 and first heat sink 16 are fixed relative to the second heat sink 22. To permit tilt aiming of the light source 14, the light fixture 10 also has an adjustable mode wherein the position of the light source 14 and first heat sink 16 are movable relative to the second heat sink 22 to allow tilt adjustment of the position of the light source 14 and the optical axis relative to the center axis 28 of the light fixture 10.

In the operation mode, the thermal interface 20 of the first heat sink 16 is pressed into contact with the thermal interface 26 of the second heat sink 22 substantially throughout a contact area (preferably at least about 100 $cm^2$), to thermally couple the first and second thermal interfaces over the contact area, whereby the second heat sink 22 is operable to remove heat directly from the first heat sink 16 by thermal conduction through the contact area to dissipate the heat into an ambient environment 60 through the fins 24.

Preferably, the first heat sink 16 and light source 14 are fixed relative to the second heat sink 22 in the operation mode, but can rotate about the rotation axis relative to the frame 12, along with the second heat sink 22. In the adjustable mode, the light source 14 and first heat sink 16 are movable relative to the second heat sink 22 to allow for adjusting the position of the light source 14 relative to the second heat sink 22 (i.e., tilt). In the adjustable mode, the thermal interface 20 of the first heat sink 16 is displaced (e.g., spaced) from the thermal interface 26 of the second heat sink 22, and the position of the first heat sink 16 and light source 14 is adjustable relative to the second heat sink 22 to a plurality of operation positions along an adjustment path (or preferably continuously to any position along the path). The light fixture 10 can be, alternately, in either the operation (fixed) mode or adjustable mode in any of the operation positions along the adjustment path.

Preferably, the adjustment path follows a curve lying on a plane parallel to the center axis 28 of the light fixture and concave toward the plane of the aperture 30 such that, during movement of the first heat sink 16 and light source 14 along the adjustment path, the optical axis of the light source 14 pivots (tilts) relative to the center axis 28 of the light fixture. Preferably, in a first operation position along the path, the optical axis is co-linear with the center axis 28 (See FIG. 3), and in all other operation positions, the optical axis is angularly displaced from, but intersects the center axis 28 at the center 31 of the aperture 30 (See FIG. 5).

Figure 3:
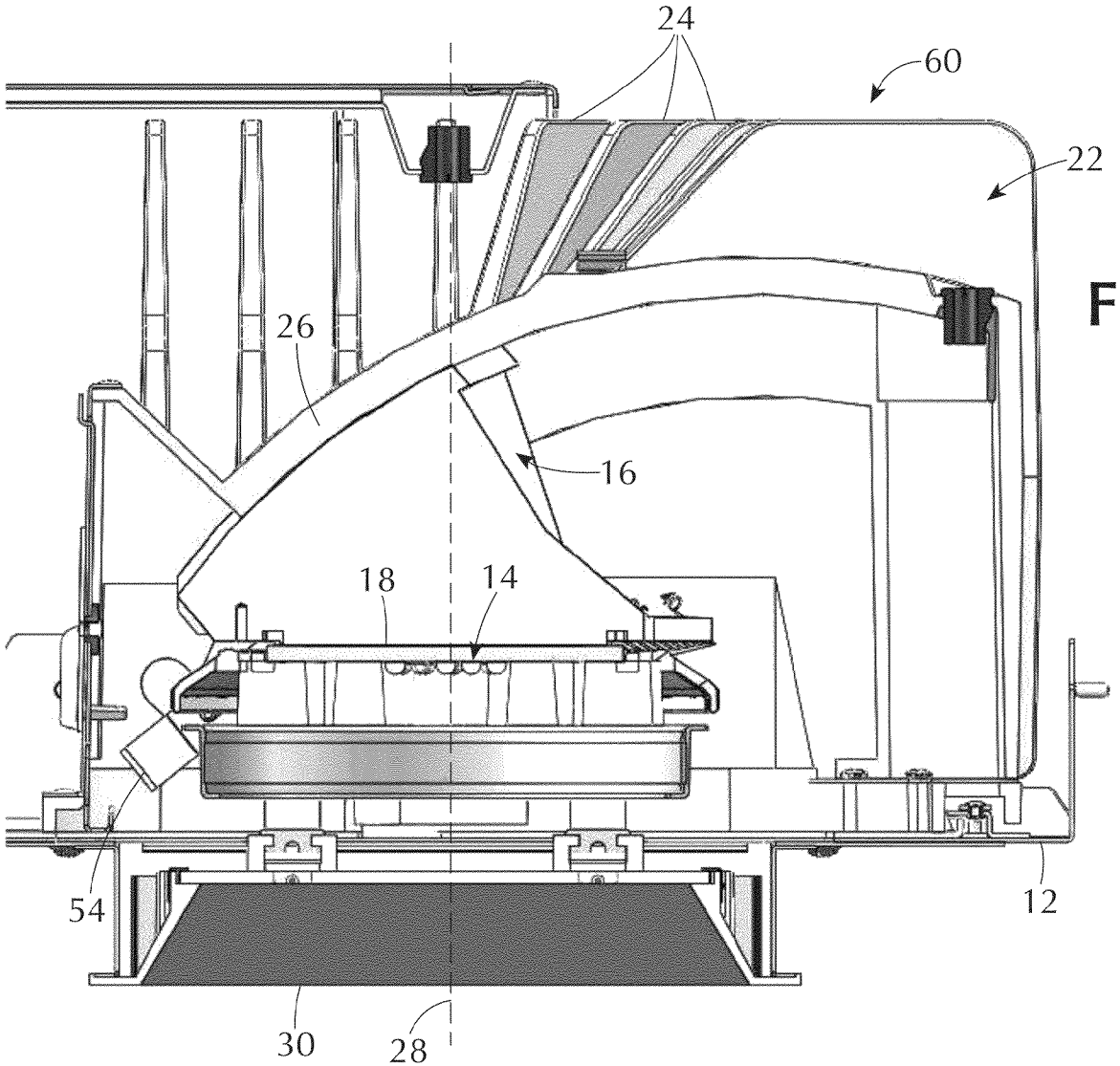
FIG. 3 is an elevation view in cross-section of the heat dissipation system of the light fixture of FIG. 1, showing the light source in a zero (0) degree tilt orientation and the modality changing linkage in the locked position.
Figure 4:
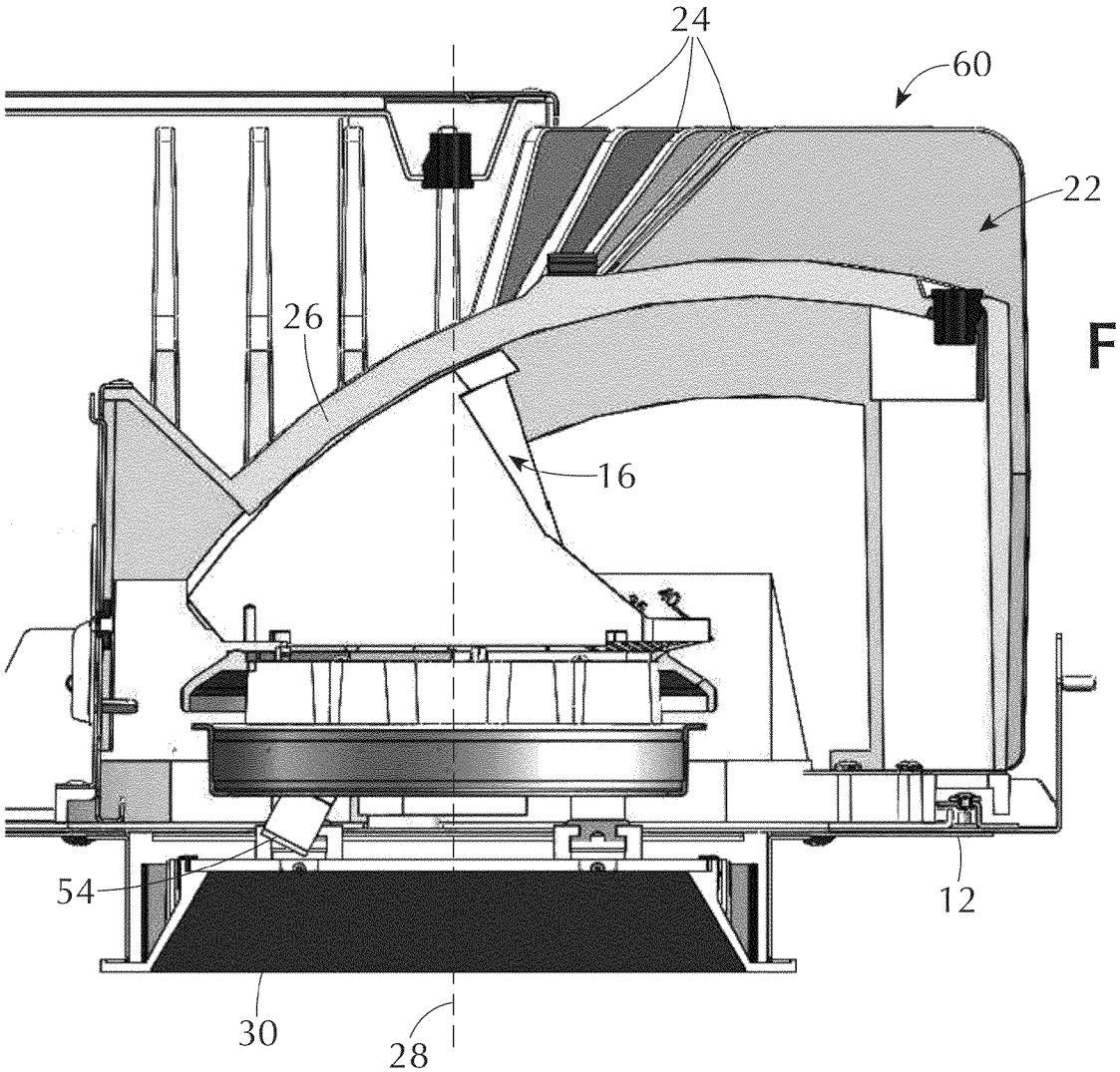
FIG. 4 is an elevation view in cross-section of the heat dissipation system of the light fixture of FIG. 1, showing the light source in a zero (0) degree tilt orientation and the modality changing linkage in the unlocked position.
Figure 5:
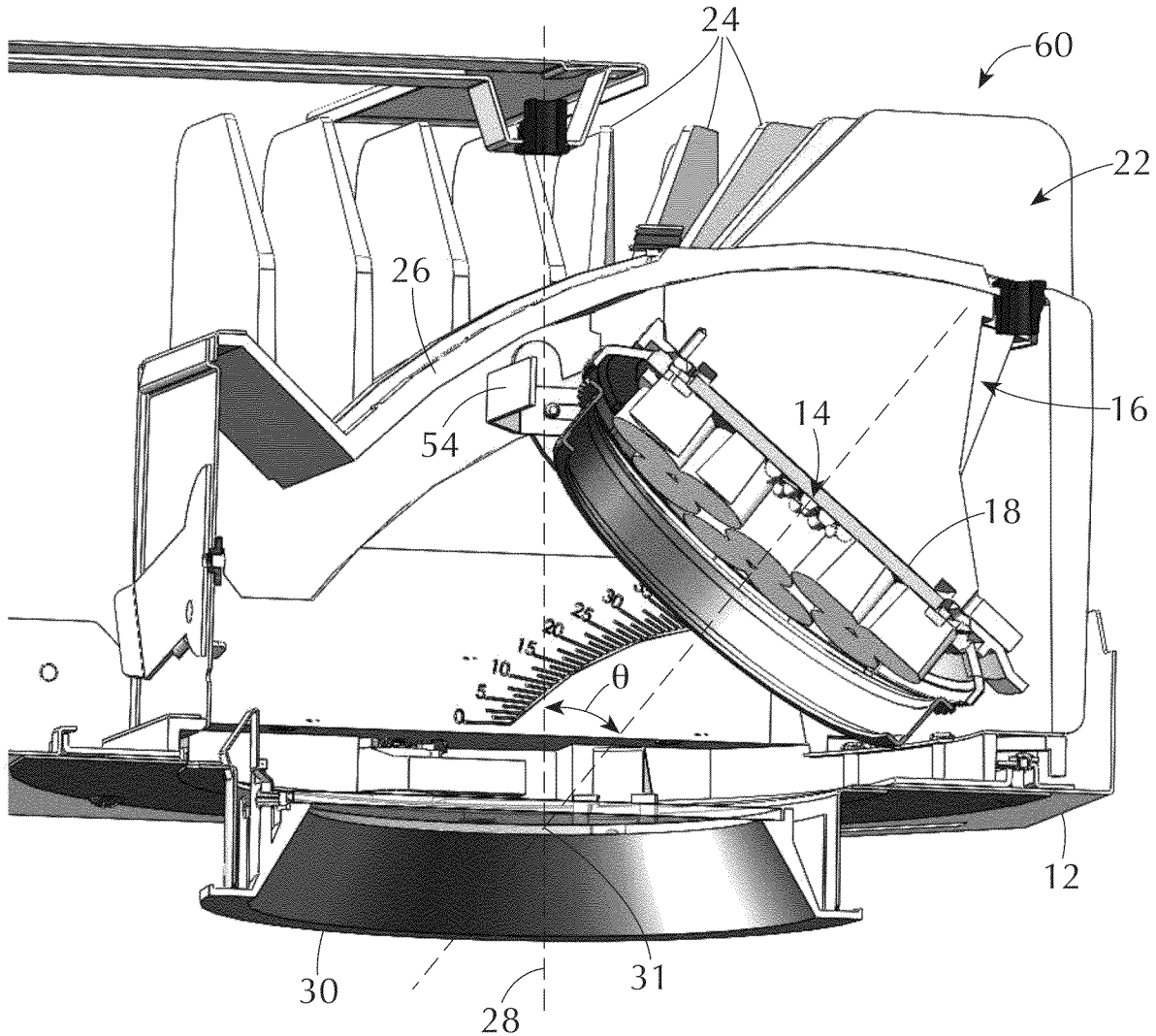
FIG. 5 is a perspective view in cross-section of the heat dissipation system of the light fixture of FIG. 1, showing the light source in a tilted orientation and the modality changing linkage in the locked position.
Figure 6:
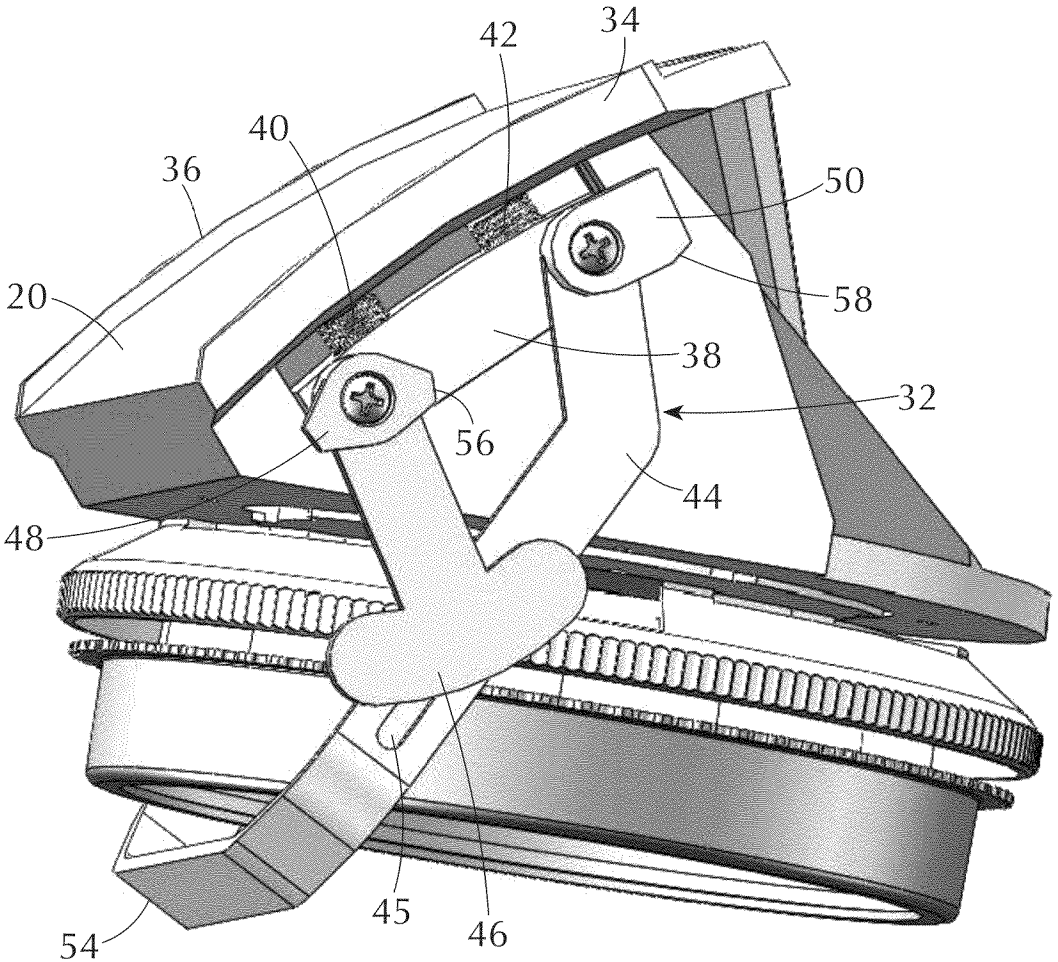
FIG. 6 is a perspective view of an assembly of the light source and first heat sink of the light fixture of FIG. 1, showing the modality changing linkage in the unlocked position.
Figure 7:
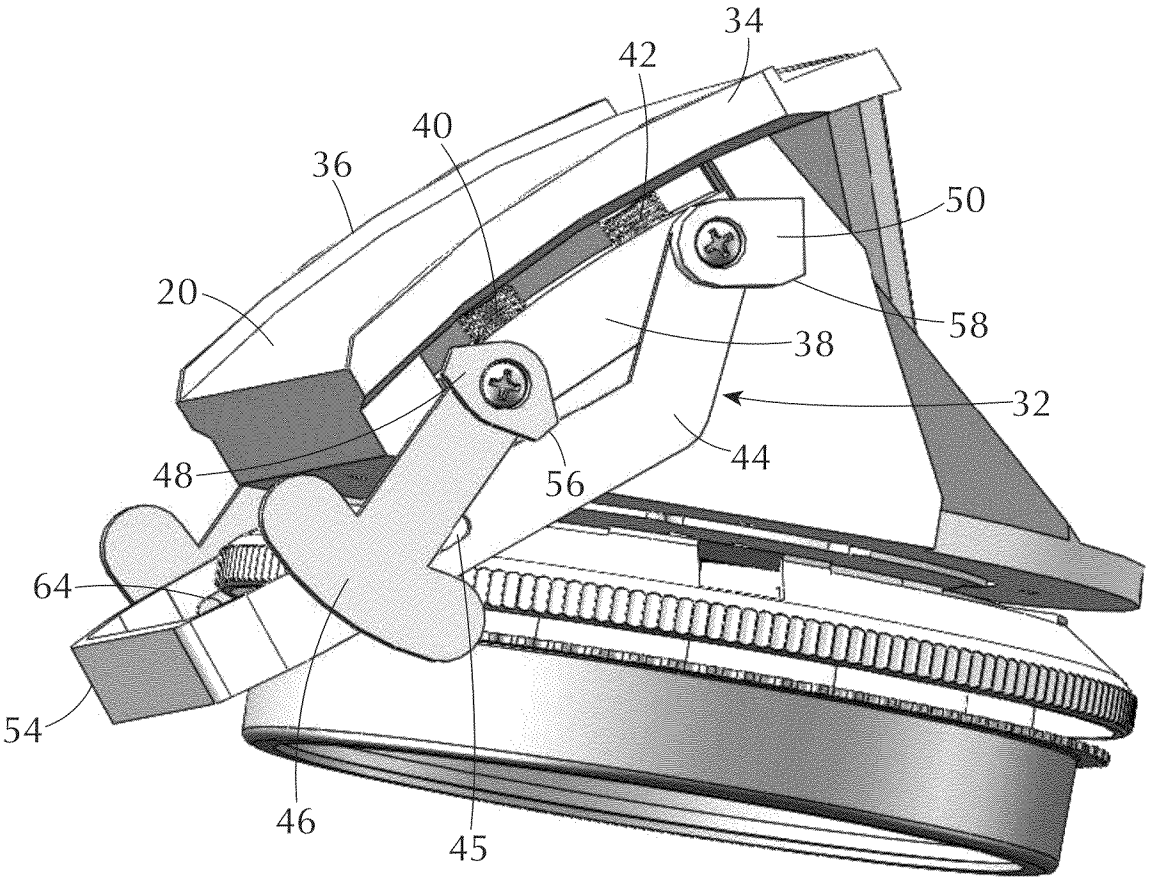
FIG. 7 is a perspective view of the assembly of the light source and first heat sink of the light fixture of FIG. 1, showing the modality changing linkage in the locked position.
Figure 8:
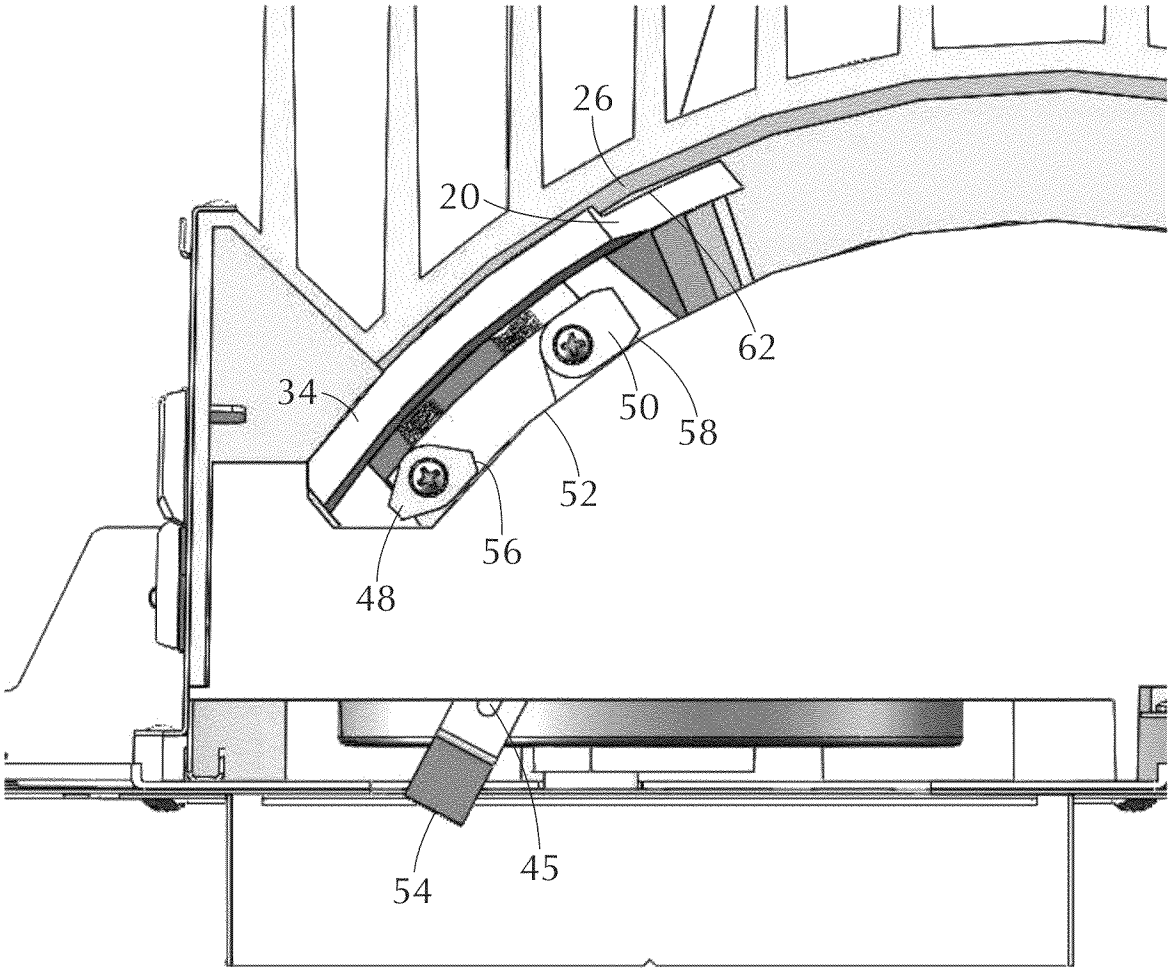
FIG. 8 is an elevation view in cross section of the light fixture of FIG. 1 showing the light fixture in the adjustment mode, with the modality changing linkage in the unlocked position and a gap between the thermal interface of the first heat sink and the thermal interface of the second heat sink.
Figure 9:
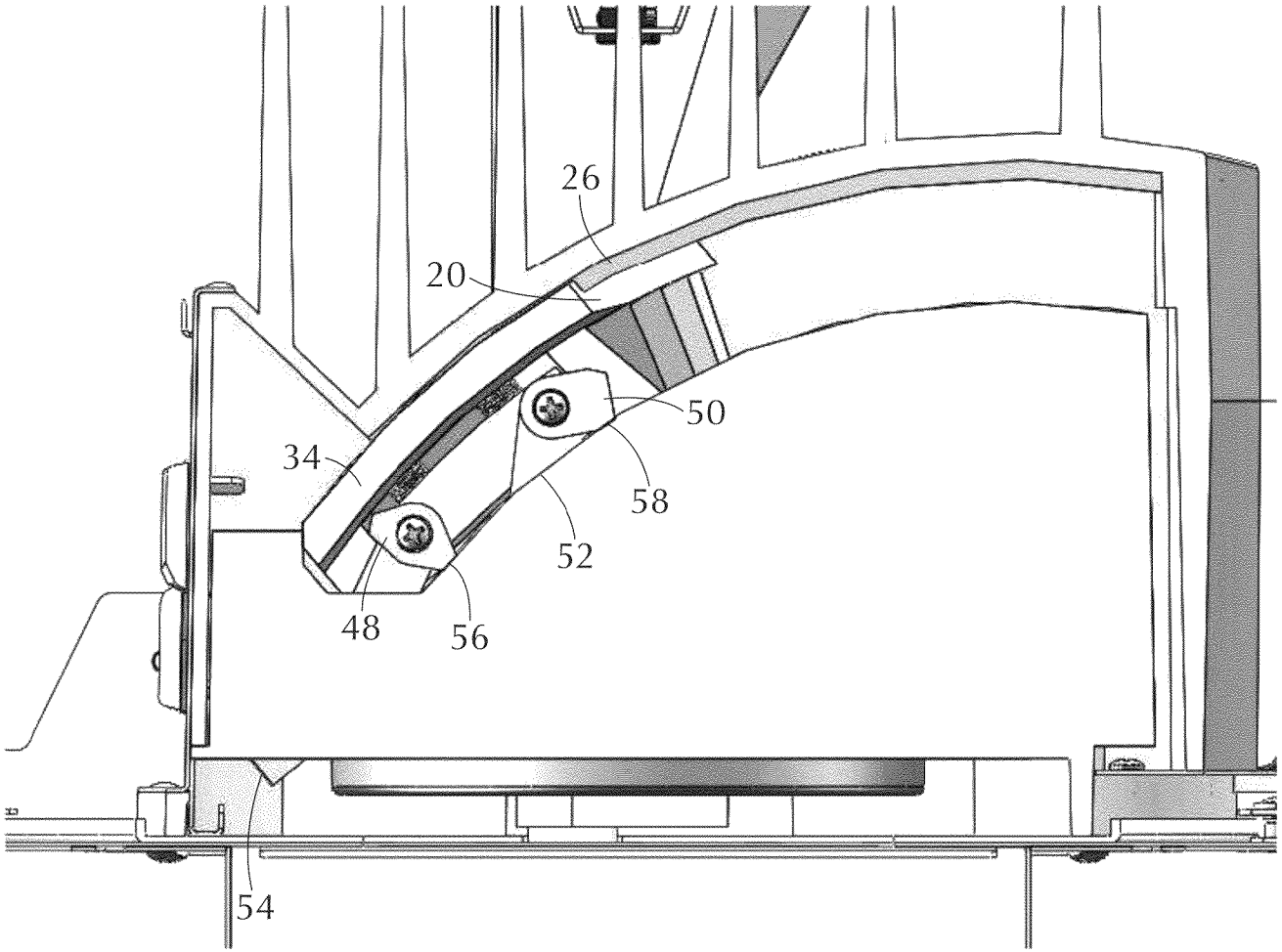
FIG. 9 is an elevation view in cross section of the light fixture of FIG. 1 showing the light fixture in the operation mode, with the modality changing linkage in the locked position and the thermal interface of the first heat sink in contact with the thermal interface of the second heat sink.

The adjustable mode allows the light fixture 10 to change from, for example, a down-light orientation wherein the light emitted from the light fixture is directed straight through (perpendicular) to an aperture plane of the light fixture (e.g., at zero (0) degree tilt; FIG. 3), to a wall-wash orientation wherein the light is emitted through the aperture at an acute angle (Θ) relative to the aperture plane (e.g., up to forty (40) degrees tilt, or more; FIG. 5). Preferably, the first operator position (zero (0) degree tilt) is a limit position at one end of the adjustment path so that the light fixture can be easily and reliably placed in the zero (0) degree tilt position.

To accommodate the curved adjustment path, the thermal interfaces 20, 26 of the first and second heat sinks 16, 22 have complementary curved surfaces. Preferably, the thermal interface 20 of the first heat sink 16 is in the form of a partially cylindrical convex surface having a radius of curvature equal to that of the curved adjustment path, and the thermal interface 26 of the second heat sink 22 is in the form of a complementary, partially cylindrical concave surface. However, preferably, an arc length of the thermal interface 26 of the second heat sink 22 (as measured along the adjustment path) is substantially longer than an arc length of the thermal interface 20 of the first heat sink 16. For example, the arc length of the thermal interface 26 of the second heat sink 22 may be 2 to 10 times greater than that of the first thermal interface 20 to allow the first heat sink 16 to thermally couple with the second heat sink 22 in at least two non-overlapping positions along the adjustment path.

The light fixture 10 preferably has a linkage mechanism 32 connected to the first heat sink 16 to change the modality of the light fixture 10 between the operation mode and the adjustment mode. The linkage 32 includes, on each of two opposed lateral sides 34, 36 of the first heat sink 16, a first link 38 connected to the first heat sink 16 by one or more resiliently deformable members, such as a plurality of springs 40, 42, adapted to bias the thermal interface 20 of the first heat sink 16 against the thermal interface 26 of the second heat sink 22 in the operation mode.

On each lateral side 34, 36, the linkage 32 also includes second and third links 44, 46 pivotally connected to the first link 38, preferably at first and second ends thereof, respectively. The second and third links 44, 46 are connected together by a pin 64 (see FIG. 7) on one of the second and third links which is received in a complementary slot 45 in the other link. Each lateral side 34, 36 also includes first and second cams 48, 50 integrally formed with, or fixed relative to, the second and third links 44, 46, respectively. Preferably, the cams 48, 50 rotate about points where the associated second and third links 44, 46 pivot relative to the first link 38. The cams 48, 50 are operable to bear on one of two parallel guide rails 52 on either lateral side of the first heat sink, which guide rails are preferably integrally formed with (or fixed relative to) the second heat sink 22. Preferably, the guide rails 52 are curved, forming the aforementioned curved adjustment path.

Preferably, the second links 44 of each side of the linkage 32 are interconnected by a handle 54 which is accessible by a user through the aperture 30 of the light fixture 10 so that a user can adjust and fix the position of the light source 14 using one hand, after the light fixture 10 is installed.

To place the light fixture 10 in the operation mode, the linkage 32 is moved to a locked position (FIG. 9), for example by urging the handle 54 toward the second heat sink 22, causing the cams 48, 50 to rotate and bear on the associated guide rail 52 and the thermal interface 20 of the first heat sink 16 to move toward and press against the thermal interface 26 of the second heat sink 22 (via the first link 38 and the resiliently deformable members 42, 44) forming a direct thermal connection between the first and second heat sinks 16, 22. Preferably, the linkage 32 remains in the locked position and maintains the light fixture 10 in the operation mode unless urged out of the locked position. For example, each cam 48, 50 can include a flat surface 56, 58 which is tangential to and bears on the guide rail 52 in the operation mode to maintain the light fixture 10 in the operation mode. Preferably, the resiliently deformable members 42, 44 provide for relatively constant contact pressure between the two thermal interfaces 20, 26 among the various operation positions along the adjustment path, which contact pressure maintains the light fixture in the operation mode.

To place the light fixture 10 in the adjustable position, the linkage 32 is moved to an unlocked position (FIG. 8), for example by moving the handle 54 away from the second heat sink 22, causing the cams 48, 50 to rotate and allowing the first link 38 and thermal interface 20 of the first heat sink 16 to release and move away from the thermal interface 26 of the second heat sink 22 such that the thermal interface 20 of the first heat sink 16 is displaced from the thermal interface 26 of the second heat sink 22, creating a gap 62.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A light fixture comprising:

a light source;

first and second heat sinks;

the light source being mounted to the first heat sink, and the first heat sink being operable to conduct heat generated by the light source during operation of the light fixture;

the light fixture having an operation mode and an adjustable mode;

in the operation mode, the first heat sink being fixed relative to the second heat sink, a first thermal interface of the first heat sink being pressed into contact with a second thermal interface of the second heat sink in a contact area, and the second heat sink being operable to conduct heat from the first heat sink through the contact area and to dissipate such heat into an ambient environment;

in the adjustable mode, the first heat sink being movable relative to the second heat sink to a plurality of operation positions to allow adjustment of a position of the light source relative to the second heat sink; and the light fixture being operable to be, alternately, in the operation mode or the adjustable mode in any of the plurality of operation positions.

2. The light fixture of claim 1, further comprising:

means to generate contact pressure between the first and second thermal interfaces, in the operation mode of the light fixture.

3. The light fixture of claim 1, further comprising:

in the adjustable mode, the first thermal interface being displaced from the second thermal interface.

4. The light fixture of claim 1, further comprising:

the contact area being at least about 100 $cm^2$.

5. The light fixture of claim 1, further comprising:

in the adjustable mode, the first heat sink being continuously movable relative to the second heat sink along an adjustment path, and the light fixture being operable to be, alternatively, in the operation mode or the adjustable mode in any position along the path.

6. The light fixture of claim 5, further comprising:

the adjustment path being curved; and the first and second thermal interfaces having complementary curved surfaces.

7. The light fixture of claim 6, further comprising:

the first thermal interface having a convex curved surface; and the second thermal interface having a concave curved surface.

8. The light fixture of claim 7, further comprising:

the first thermal interface being in the form of a partially cylindrical convex surface;

the second thermal interface being in the form of a partially cylindrical concave surface, complementary to the first thermal interface; and an arc length of the second thermal interface being substantially greater than an arc length of the first thermal interface.

9. The light fixture of claim 1, further comprising:

means to change a modality of the light fixture between the operation and adjustable modes; and the modality changing means being operable to maintain the light fixture in the operation mode.

10. The light fixture of claim 9, further comprising:

the modality changing means comprising a first guide fixed relative to the second heat sink and a first cam connected to the first heat sink;

in the operation mode, the first cam bearing on the first guide and pressing the first thermal interface against the second thermal interface; and in the adjustable mode, the first cam releasing the first thermal interface from the second thermal interface.

11. The light fixture of claim 10, further comprising:

the first cam being connected to the first heat sink through an elastic means;

in the operation mode, the elastic means being deformed; and in the adjustable mode, the elastic means being at rest.

12. The light fixture of claim 11, further comprising:

the first cam having a flat surface, and, in the operation mode, the flat surface bearing on the guide to maintain the light fixture in the operation mode.

13. The light fixture of claim 11, further comprising:

the modality changing means comprising a second guide fixed relative to the second heat sink, and comprising first and second pairs of cams connected to the first heat sink through the elastic means, the first and second pairs of cams being disposed on opposed sides of the first thermal interface;

in the operation mode, the first and second pairs of cams bearing on the first and second guides, respectively, and pressing the first thermal interface against the second thermal interface;

in the adjustable mode, the first and second pairs of cams releasing the first thermal interface from the second thermal interface; and the modality changing means further comprising a linkage connected to the first and second pairs of cams.

14. The light fixture of claim 12, further comprising:

the linkage comprising a handle adapted to articulate the linkage to change the modality of the light fixture; and the handle being accessible by a user through an aperture of the light fixture.

15. The light fixture of claim 1, further comprising:

an illumination aperture operable to pass light emanating from the light source, the illumination aperture having an aperture plane;

in a first operation position, an optical axis of the light source passing through a center of the illumination aperture at a first angle relative to the aperture plane; and in a second operation position, the optical axis of the light source passing through the center of the illumination aperture at a second angle relative to the aperture plane different than the first angle.

16. The light fixture of claim 15, further comprising:

a support;

the second heat sink being operable to rotate relative to the support; and the first heat sink being supported by the second heat sink.

17. A light fixture comprising:

a light source;

a first heat sink having a first thermal interface and a second heat sink having a second thermal interface, the first and second thermal interfaces having complementary curved surfaces;

the light source being mounted to the first heat sink, and the first heat sink being operable to conduct heat generated by the light source during operation of the light fixture;

the light fixture having an operation mode and an adjustable mode;

in the operation mode, the first heat sink being fixed relative to the second heat sink, the first thermal interface of the first heat sink being pressed into contact with the second thermal interface of the second heat sink in a contact area, and the second heat sink being operable to remove heat directly from the first heat sink by thermal conduction through the contact area and to dissipate such heat into an ambient environment;

in the adjustable mode, the first heat sink being movable relative to the second heat sink along a curved adjustment path to allow adjustment of a position of the light source relative to the second heat sink;

in a first position of the first heat sink on the adjustment path, an optical axis of the light source being substantially co-linear with a center axis of the light fixture passing through a center of an aperture of the light fixture perpendicular to a plane of the aperture, and in a second position of the first heat sink on the adjustment path, an optical axis of the light source set at an angle relative to, and intersecting the center axis substantially at the center of the aperture; and the light fixture being operable to be in the operation mode or the adjustable mode in a plurality of positions along the adjustment path.

18. The light fixture of claim 17, further comprising:

means to change a modality of the light fixture between the operation and adjustable modes; and the modality changing means being operable to maintain the light fixture in the operation mode.

19. The light fixture of claim 17, further comprising:

a support;

the second heat sink being operable to rotate relative to the support; and the first heat sink being supported by the second heat sink.

20. The light fixture of claim 17, further comprising:

in the adjustable mode, the first heat sink being continuously movable relative to the second heat sink along the curved adjustment path; and the light fixture being operable to be in the operation mode or the adjustable mode in any position along the adjustment path.

* * * * *